US011641939B2

(12) United States Patent
Chen et al.

(10) Patent No.: US 11,641,939 B2
(45) **Date of Patent: *May 9, 2023**

(54) SLIDE RAIL ASSEMBLY AND SLIDE RAIL KIT THEREOF

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Wei-Chen Chang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 51 days.

This patent is subject to a terminal disclaimer.

(21) Appl. No.: 17/347,609

(22) Filed: Jun. 15, 2021

(65) Prior Publication Data

US 2022/0192376 A1 Jun. 23, 2022

(30) Foreign Application Priority Data

Dec. 22, 2020 (TW) ..... 109145878

(51) Int. Cl.
*A47B 88/49* (2017.01)
*A47B 88/57* (2017.01)

(52) U.S. Cl.
CPC ..... *A47B 88/49* (2017.01); *A47B 88/57* (2017.01); *A47B 2210/0018* (2013.01)

(58) Field of Classification Search
CPC .. A47B 88/49; A47B 88/57; A47B 2210/0018
See application file for complete search history.

(56) References Cited

U.S. PATENT DOCUMENTS 6,945,619 B1 * 9/2005 Chen ..... A47B 88/487 312/334.47
8,662,607 B2 * 3/2014 Fan ..... H05K 7/1489 312/334.47

(Continued)

FOREIGN PATENT DOCUMENTS

EP 3 292 788 A1 3/2018
EP 3 505 010 A1 7/2019

(Continued)

*Primary Examiner* — James O Hansen
(74) *Attorney, Agent, or Firm* — Winston Hsu

(57) ABSTRACT

A slide rail assembly and a slide rail kit are provided. The slide rail assembly includes a first rail, a second rail, a blocking member, and an operating member. The blocking member is movably mounted on the second rail. When the second rail is positioned at an extending position relative to the first rail, a blocking feature of the first rail blocks the blocking member at a first state, so as to prevent the second rail from being moved from the extending position in a retracting direction. The operating member is operated to be positioned at a position that moves the blocking member from the first state to a second state, such that the blocking feature is unable to block the blocking member at the second state. The operating member is engaged with the predetermined portion of the second rail to be retained at the position.

13 Claims, 17 Drawing Sheets

(56) References Cited

U.S. PATENT DOCUMENTS

| | | | | |
|---|---|---|---|---|
| 9,629,459 | B2 | 4/2017 | Chen | |
| 9,681,749 | B2 * | 6/2017 | Chen | H05K 7/1489 |
| 9,980,566 | B2 * | 5/2018 | Chen | F16C 43/04 |
| 9,992,906 | B2 | 6/2018 | Chen | |
| 10,041,535 | B2 | 8/2018 | Chen et al. | |
| 10,244,868 | B2 | 4/2019 | Chen | |
| 10,413,065 | B2 | 9/2019 | Chen | |
| 11,060,558 | B2 | 7/2021 | Chen | |
| 2007/0170830 | A1 * | 7/2007 | Huang | A47B 88/487 312/334.47 |
| 2016/0060934 | A1 | 3/2016 | Chen | |
| 2016/0296017 | A1 * | 10/2016 | Chen | H05K 7/183 |
| 2020/0392990 | A1 | 12/2020 | Chen | |

FOREIGN PATENT DOCUMENTS

| | | | |
|---|---|---|---|
| JP | 3201270 | U | 12/2015 |
| JP | 2016-198474 | A | 12/2016 |
| JP | 2017-127625 | A | 7/2017 |
| JP | 2018-42993 | A | 3/2018 |
| JP | 2019-118788 | A | 7/2019 |
| JP | 2020-199241 | A | 12/2020 |

* cited by examiner

SLIDE RAIL ASSEMBLY AND SLIDE RAIL KIT THEREOF

BACKGROUND OF THE INVENTION

1. Field of the Invention

The present invention relates to a slide rail assembly, and more particularly, to a slide rail assembly including slide rails, wherein when a slide rail is opened, an operating member is utilized for releasing an engaging relation between a central rail and an outer rail in advance, and then the central rail can be retracted to and positioned at a predetermined position, such that an inner rail can be pulled out independently, so as to facilitate the usage of the slide rail assembly in a confined space.

2. Description of the Prior Art

U.S. Pat. No. 10,041,535 B2 discloses a slide rail assembly including a first rail, a second rail, a third rail, a locking member, and an operating member. The second rail is movable relative to the first rail between a first position and a second position. The third rail is movable relative to the second rail. The locking member is mounted on the second rail. When the second rail is positioned at the second position, the locking member is configured to lock a portion of the first rail, such that the second rail is not movable relative to the first rail from the second position toward the first position. The operating member is configured to be operated by a user to unlock the portion of the first rail from the locking member. When the operating member is moved from the first predetermined position to the second predetermined position through a force applied by the user, although the locking member can be used to unlock the part of the first rail, the disengaging action of the third rail from the second rail relies on a cooperation with a movement of the second rail that is pushed into the first rail. That is to say, such manner of operation is not suitable for single-person operation, and a trolley is required to disengage a chassis arranged with a third rail from the second rail in a confined space.

U.S. Pat. No. 9,681,749 B2 (case '749) discloses a slide rail assembly that can be adapted to confined spaces. Case '749 discloses that the operating member can be returned to an initial position from a predetermined position through a recovering elastic member. In other words, once the user blockings applying a force to the operating member, the operating member will be forced to return from the predetermined position to the initial position in response to the elastic force provided by the recovering elastic member. However, when two sets of slide rails are installed on one side of the chassis, there will be four slide rails on both sides of the chassis. Therefore, it is even more inadequate for single-handed operation. Therefore, the mechanism of the recovering elastic member forcing the operating member back to the initial position from the predetermined location through the elastic force provided by the recovering elastic member is unable to meet the requirements on the market in the industry.

SUMMARY OF THE INVENTION

The present invention provides a slide rail assembly, which enables a slide rail to be retracted from an extending position relative to another slide rail through an operating member releasing a blocking relation.

According to an embodiment of the present invention, a slide rail assembly includes a first rail, a second rail, a blocking member, and an operating member configured to operate the blocking member. The first rail includes a blocking feature. The second rail is movable relative to the first rail, and the second rail has a predetermined portion. The blocking member is movably mounted on the second rail, such that the blocking member, relative to the second rail, is at one of a first state and a second state. The operating member is configured to operate the blocking member. When the second rail is positioned at a first extending position relative to the first rail, the blocking feature blocks the blocking member at the first state, so as to prevent the second rail from being moved in a retracting direction from the first extending position. The blocking member is movable from the first state to the second state through having the operating member operatively moved from a first operating position to a second operating position, such that the blocking feature is unable to block the blocking member at the second state, so as to allow the second rail to be moved in the retracting direction from the first extending position. When the operating member is positioned at the second operating position, the operating member is engaged with the predetermined portion through an engaging feature, such that the operating member is retained at the second operating position.

According to another embodiment of the present invention, a slide rail assembly includes a first rail, a second rail, a third rail, a blocking member, a positioning member, and an operating member configured to operate the blocking member. The first rail includes a blocking feature and a positioning feature. The second rail is movable relative to the first rail, and the second rail includes a predetermined portion. The third rail is movable relative to the second rail. The blocking member and the positioning member are movably mounted on the second rail, such that the blocking member and the positioning member, relative to the second rail, are both respectively at one of a first state and a second state. When the second rail is positioned at a first extending position relative to the first rail, the blocking feature blocks the blocking member at the first state, so as to prevent the second rail from being moved in a retracting direction from the first extending position. The blocking member is movable from the first state to the second state through having the operating member operatively moved from a first operating position to a second operating position, such that the blocking feature is unable to block the blocking member at the second state, so as to allow the second rail to be moved in the retracting direction from the first extending position, and when the operating member is positioned at the second operating position, the operating member is engaged with the predetermined portion of the second rail through an engaging feature, such that the operating member is retained at the second operating position. When the operating member is positioned at the second operating position, the operating member retains the blocking member at the second state. When the blocking feature is unable to block the blocking member at the second state, the second rail is moved in a retracting direction from the first extending position to a second extending position, such that the second rail is prevented from being moved in the retracting direction from the second extending position relative to the first rail through the positioning member at the first state being engaged with the positioning feature.

According to yet another embodiment of the present invention, a slide rail kit includes a slide rail, a blocking member, an operating member configured to operate the blocking member, and a recovering elastic member. The slide rail includes a predetermined portion. The blocking member is movably mounted on the slide rail, such that the blocking member, relative to the slide rail, is at one of a first state and a second state. The blocking member is movable from the first state to the second state through having the operating member operatively moved from a first operating position to a second operating position. When the operating member is positioned at the second operating position, the operating member is engaged with the predetermined portion of the slide rail through an engaging feature, such that the operating member is retained at the second operating position. When the engaging feature is no longer engaged with the predetermined portion of the slide rail, a recovering elastic force provided by the recovering elastic member is applied to the operating member, so as to return the operating member from the second operating position to the first operating position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
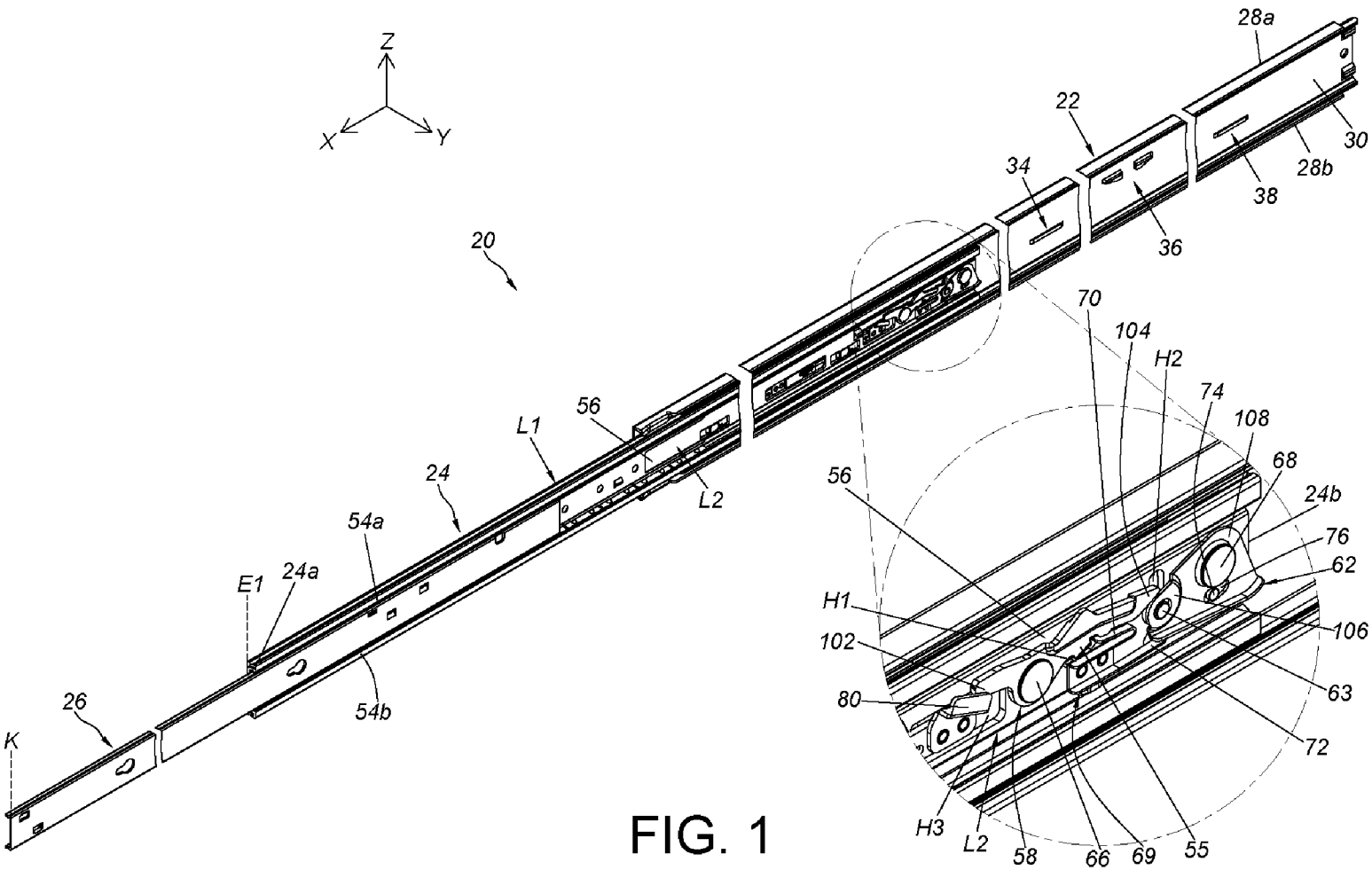
FIG. 1 is a schematic assembled perspective view of a slide rail assembly, including a first rail, a second rail, and a third rail, at an extending state according to one embodiment of the present invention.
Figures 2, 3:
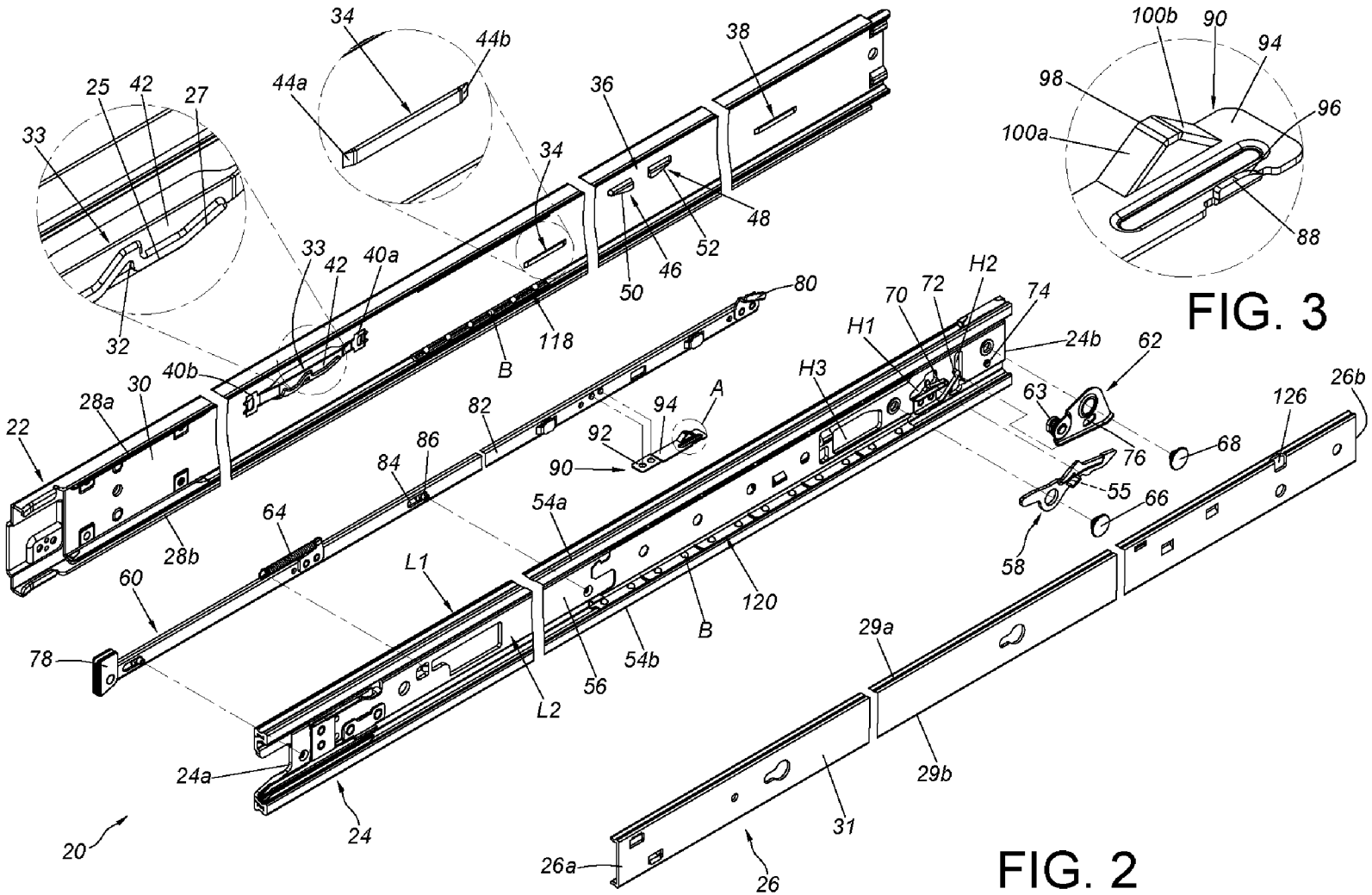
FIG. 2 is a schematic exploded perspective view of the slide rail assembly according to one embodiment of the present invention.
FIG. 3 is an enlarged schematic view of part A in FIG. 2.

As shown in FIG. 1 and FIG. 2, a slide rail assembly 20 according to one embodiment of the present invention includes a first rail 22 and a second rail 24, and preferably, further includes a third rail 26. The second rail 24 is movably mounted between the first rail 22 and the third rail 26. The first rail 22 (e.g., an outer rail), the second rail 24 (e.g., a middle rail), and the third rail 26 (e.g., the inner rail) can move on a longitudinal direction relative to one another.

When the slide rail assembly 20 is in a fully extended state, the second rail 24 is in a first extending position E1 relative to the first rail 22, and the third rail 26 is in an open position K relative to the second rail 24. It is worth mentioning that, in this embodiment, the X-axis direction is the longitudinal direction (or a length direction of each of the slide rails or a moving direction of the slide rails), the Y-axis direction is the transverse direction (or a lateral direction of each of the slide rails), and the Z-axis direction is the vertical direction (or a height direction of each of the slide rails).

The first rail 22 includes a first wall 28*a*, a second wall 28*b*, and a longitudinal wall 30 connected between the first wall 28*a* and the second wall 28*b* of the first rail 22. The first wall 28*a*, the second wall 28*b* and the longitudinal wall 30 of the first rail 22 jointly define a first channel, and the first channel is used to accommodate the second rail 24. The first rail 22 includes a blocking feature 32 (as shown in FIG. 2). Preferably, the first rail 22 further includes a first released feature 34, a positioning feature 36 and a second released feature 38. The blocking feature 32, the first released feature 34, the positioning feature 36 and the second released feature 38 are arranged in sequence from front to back on the longitudinal wall 30 of the first rail 22.

Preferably, the slide rail assembly 20 further includes an elastic seat 33 mounted on the first rail 22, and the elastic seat 33 includes a first connecting portion 40*a*, a second connecting portion 40*b* and a supporting structure 42 (as shown in FIG. 2), the first connecting portion 40*a* and the second connecting portion 40*b* are both connected to the longitudinal wall 30 of the first rail 22, and the supporting structure 42 is positioned between the first connecting portion 40*a* and the second connecting portion 40*b*. The supporting structure 42 includes the blocking feature 32, a longitudinal portion 25, and a guiding portion 27. In addition, the blocking feature 32 can be exemplified as a retaining wall (or a standing wall), but the present invention is not limited thereto. Furthermore, the longitudinal portion 25 is positioned between the blocking feature 32 and the guiding portion 27, and the guiding portion 27 is, for example, an inclined surface or an arc surface.

Preferably, the first released feature 34 and the second released feature 38 have structural configurations that are substantially identical. For ease of illustration, only the first released feature 34 is described herein. For example, the first released feature 34 is a protrusion protruding laterally (or transversely) relatively to the longitudinal wall 30 of the first rail 22, and a front portion and a back portion of the first released feature 34 respectively have a first guiding section 44*a* and a second guiding section 44*b*. The first guiding section 44*a* and the second guiding section 44*b* are inclined surfaces (or curved surfaces), but the present invention is not limited thereto.

Preferably, the slide rail assembly 20 further includes a first auxiliary portion 46 and a second auxiliary portion 48, and the positioning feature 36 is defined between the first auxiliary portion 46 and the second auxiliary portion 48. The first auxiliary portion 46 and the second auxiliary portion 48 are symmetrical to and separate from each other for a distance. The first auxiliary portion 46 and the second auxiliary portion 48 have structural configurations that are substantially identical. For ease of illustration, only the first auxiliary portion 46 is described herein. For example, the first auxiliary portion 46 is a protrusion protruding laterally (or transversely) relatively to the longitudinal wall 30 of the first rail 22.

Preferably, the first auxiliary portion 46 and the second auxiliary portion 48 respectively have a first guiding structure 50 and a second guiding structure 52, and the first guiding structure 50 and the second guiding structure 52 are inclined surfaces (or curved surfaces), but the present invention is not limited thereto.

The second rail 24 includes a first wall 54*a*, a second wall 54*b*, and a longitudinal wall 56 connected between the first wall 54*a* and the second wall 54*b* of the second rail 24. The first wall 54*a*, the second wall 54*b*, and the longitudinal wall 56 of the second rail 24 jointly define a second channel, and the second channel is used to accommodate the third rail 26. The second rail 24 has a first side L1 and a second side L2 that are opposite to each other in position. The first side L1 is adjacent to the first rail 22, and the second side L2 is adjacent to the third rail 26.

The slide rail assembly 20 includes a blocking member 58 and an operating member 60, and preferably, the slide rail assembly 20 further includes a positioning member 62 and a recovering elastic member 64. The second rail 24, the blocking member 58, the operating member 60, and the recovering elastic member 64 can form a slide rail kit. The blocking member 58 and the positioning member 62 are both movably mounted on the second rail 24. In one of the implementations, the blocking member 58 and the positioning member 62 are exemplified as being pivotally connected to the second side L2 of the longitudinal wall 56 of the second rail 24 through a first shaft 66 and a second shaft 68, respectively, but the present invention is not limited thereto.

Preferably, the second rail 24 includes at least one hole communicating with the first side L1 and the second side L2 of the longitudinal wall 56 of the second rail 24. In addition, the at least one hole is exemplified as a first hole H1 and a second hole H2 herein. Furthermore, the blocking member 58 includes a blocking portion 55 penetrating into the first hole H1, the blocking portion 55 faces the longitudinal wall 30 of the first rail 22, and the blocking portion 55 is to be used in conjunction with the blocking feature 32 of the first rail 22. On the other hand, the positioning member 62 includes a positioning portion 63 penetrating into the second hole H2, the positioning portion 63 faces the longitudinal wall 30 of the first rail 22, and the positioning portion 63 is to be used in conjunction with the positioning feature 36 of the first rail 22. In addition, the positioning portion 63 is exemplified as a column, but the present invention is not limited thereto.

Preferably, the slide rail assembly 20 further includes a predetermined object 69 connected to the longitudinal wall 56 of the second rail 24, and the predetermined object 69 has a first elastic feature 70 and a second elastic feature 72, so as to provide an elastic force to the blocking member 58 and the positioning member 62, respectively.

Preferably, the second rail 24 and the positioning member 62 include limiting structures that are adapted to each other, such that the positioning member 62 can be moved relative to the second rail 24 within a limited range. In one of the implementations, the limiting structures are exemplified as the longitudinal wall 56 of the second rail 24 including a corresponding portion 74 (e.g., a convex body) penetrating a part of a limiting space 76 of the positioning member 62, but the present invention is not limited thereto.

The operating member 60 is operatively mounted on the second rail 24, and the operating member 60 is used to operate the blocking member 58 and the positioning member 62, or to operate one of the blocking member 58 and the positioning member 62.

Preferably, the operating member 60 is positioned on the first side L1 of the longitudinal wall 56 of the second rail 24, and the operating member 60 includes an operating portion 78, a driving portion 80, and an extension portion 82 connected between the operating portion 78 and the driving portion 80. The operating portion 78 is positioned at a front end portion 24*a* adjacent to the second rail 24; on the other hand, the blocking member 58 and the positioning member 62 are positioned adjacent to a back end portion 24*b* of the second rail 24.

Preferably, the second rail 24 further includes a third hole H3, through which the driving portion 80 of the operating member 60 can penetrate from the first side L1 to the second side L2 of the second rail 24 through the third hole H3, and the driving portion 80 is positioned adjacent to the blocking member 58.

Preferably, the second rail 24 and the operating member 60 include limiting features that are adapted to each other, such that the operating member 60 can be moved longitudinally relative to the second rail 24 within a limited range. In one of the implementations, the extension portion 82 of the operating member 60 are exemplified to include at least one elongated hole 84, and at least one connecting member 86 penetrates through a part of the at least one elongated hole 84, such that the at least one connecting member 86 is connected to the longitudinal wall 56 of the second rail 24, but the present invention is not limited thereto.

The recovering elastic member 64 is used to provide a recovering elastic force to the operating member 60. In one of the implementations, the two ends of the recovering elastic member 64 are exemplified as being respectively connected to the operating member 60 and the second rail 24 (the longitudinal wall 56), but the present invention is not limited thereto.

Preferably, the operating member 60 includes an engaging feature 88 (as shown in FIG. 3). The slide rail assembly 20 is exemplified as further including an elastic component 90 connected to the operating member 60, the elastic component 90 includes a connecting section 92 and an elastic section 94, the connecting section 92 is connected to the extension portion 82 of the operating member 60, the elastic section 94 is connected to the connecting section 92, and the elastic section 94 includes the engaging feature 88.

Preferably, the engaging feature 88 is, for example, a hook, and the engaging feature 88 has a guiding surface 96, such as an inclined surface or a curved surface (as shown in FIG. 3).

Preferably, the elastic section 94 of the elastic component 90 further includes a release feature 98, and the release feature 98 is, for example, a protrusion. A front portion and a back portion of the release feature 98 each have a first guiding feature 100*a* and a second guiding feature 100*b* which can each be, for example, an inclined surface or a curved surface (as shown in FIG. 3).

Figure 4:
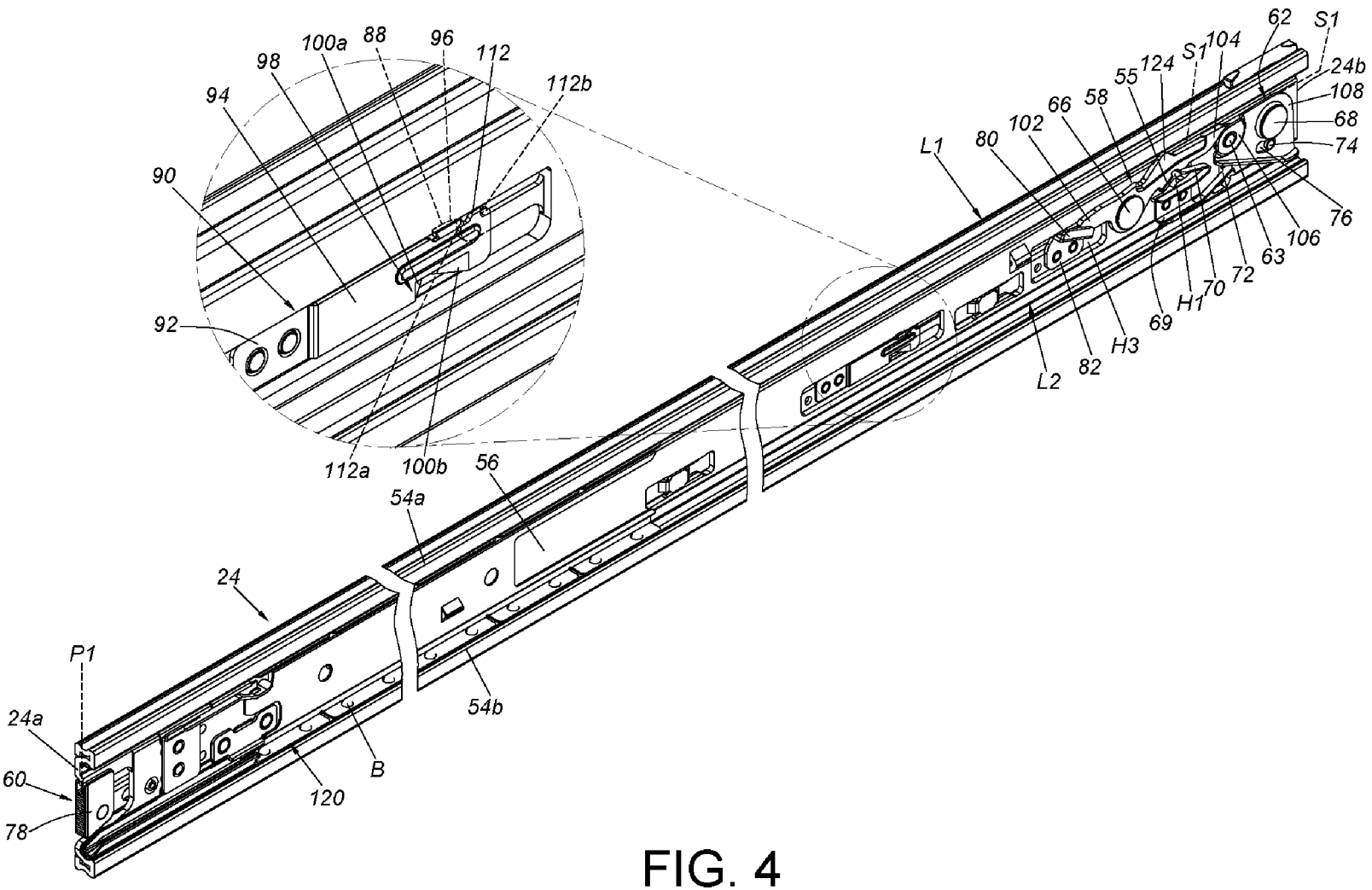
FIG. 4 is a schematic perspective view of the second rail of the slide rail assembly and an operating member of the slide rail assembly at a first operating position according to one embodiment of the present invention.
Figure 5:
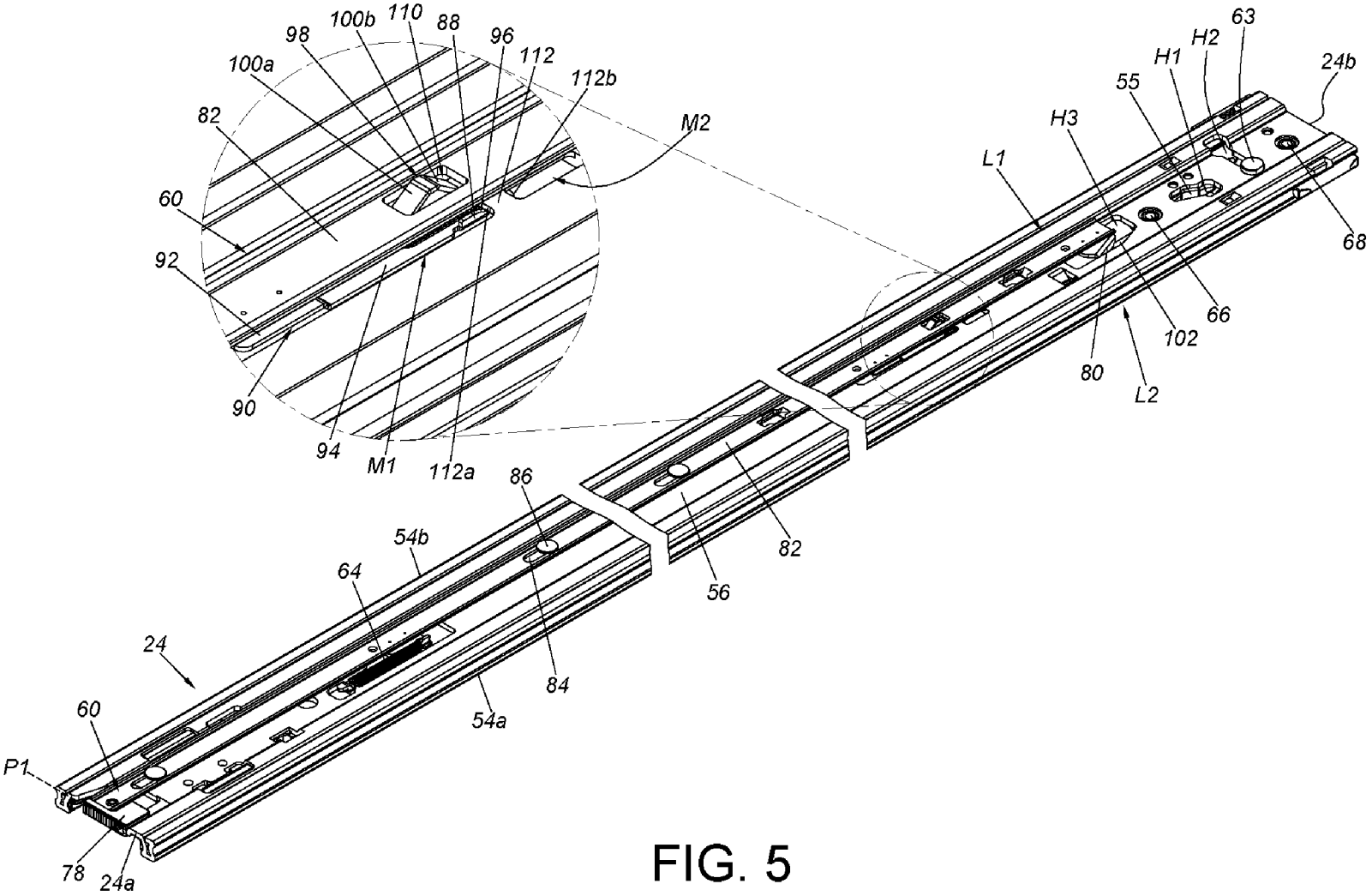
FIG. 5 is another schematic perspective view of the second rail of the slide rail assembly and the operating member of the slide rail assembly at the first operating position according to one embodiment of the present invention.

As shown in FIG. 4 and FIG. 5, both the blocking member 58 and the positioning member 62 can be in a first state S1 relative to the second rail 24 (as shown in FIG. 4). On the other hand, the operating member 60 can be positioned at a first operating position P1 relative to the second rail 24 (as shown in FIG. 4 and FIG. 5).

Preferably, the blocking member 58 further includes a contact portion 102 and an actuation portion 104, and the first shaft 66 is positioned between the contact portion 102 and the actuation portion 104. In addition, the contact portion 102 corresponds to (or contacts) the driving portion 80 of the operating member 60 (as shown in FIG. 4), the blocking portion 55 is adjacent to the actuation portion 104 (as shown in FIG. 4), and the blocking portion 55 extends to the first side L1 of the second rail 24 (as shown in FIG. 5). The first elastic feature 70 provides an elastic force to the blocking member 58, and the blocking member 58 is retained at the first state S1 (as shown in FIG. 4).

Preferably, the positioning member 62 includes a contact section 106 and an actuation section 108, and the second shaft 68 is positioned between the contact section 106 and the actuation section 108. In addition, the positioning portion 63 is adjacent to the contact section 106 (as shown in FIG. 4), and the positioning portion 63 extends to the first side L1 of the second rail 24 (as shown in FIG. 5). The second elastic feature 72 provides an elastic force to the positioning member 62, and the positioning member 62 is retained at the first state S1 (as shown in FIG. 4).

Preferably, the release feature 98 of the elastic section 94 of the elastic component 90 penetrates through a corresponding hole 110 of the extension portion 82 of the operating member 60 (as shown in FIG. 5), and the release feature 98 is to be used in conjunction with the first released feature 34 (or the second released feature 38) of the first rail 22.

Preferably, the longitudinal wall 56 of the second rail 24 has a first corresponding space M1, a second corresponding space M2, and a predetermined wall 112 positioned between the first corresponding space M1 and the second corresponding space M2, and the predetermined wall 112 separates the first corresponding space M1 from the second corresponding space M2. When the operating member 60 is positioned at the first operating position P1 relative to the second rail 24, the engaging feature 88 of the elastic component 90 corresponds to the first corresponding space M1 (as shown in FIG. 5), and the engaging feature 88 of the elastic component 90 is adjacent to a first wall portion 112*a* of the predetermined wall 112.

Figure 6:
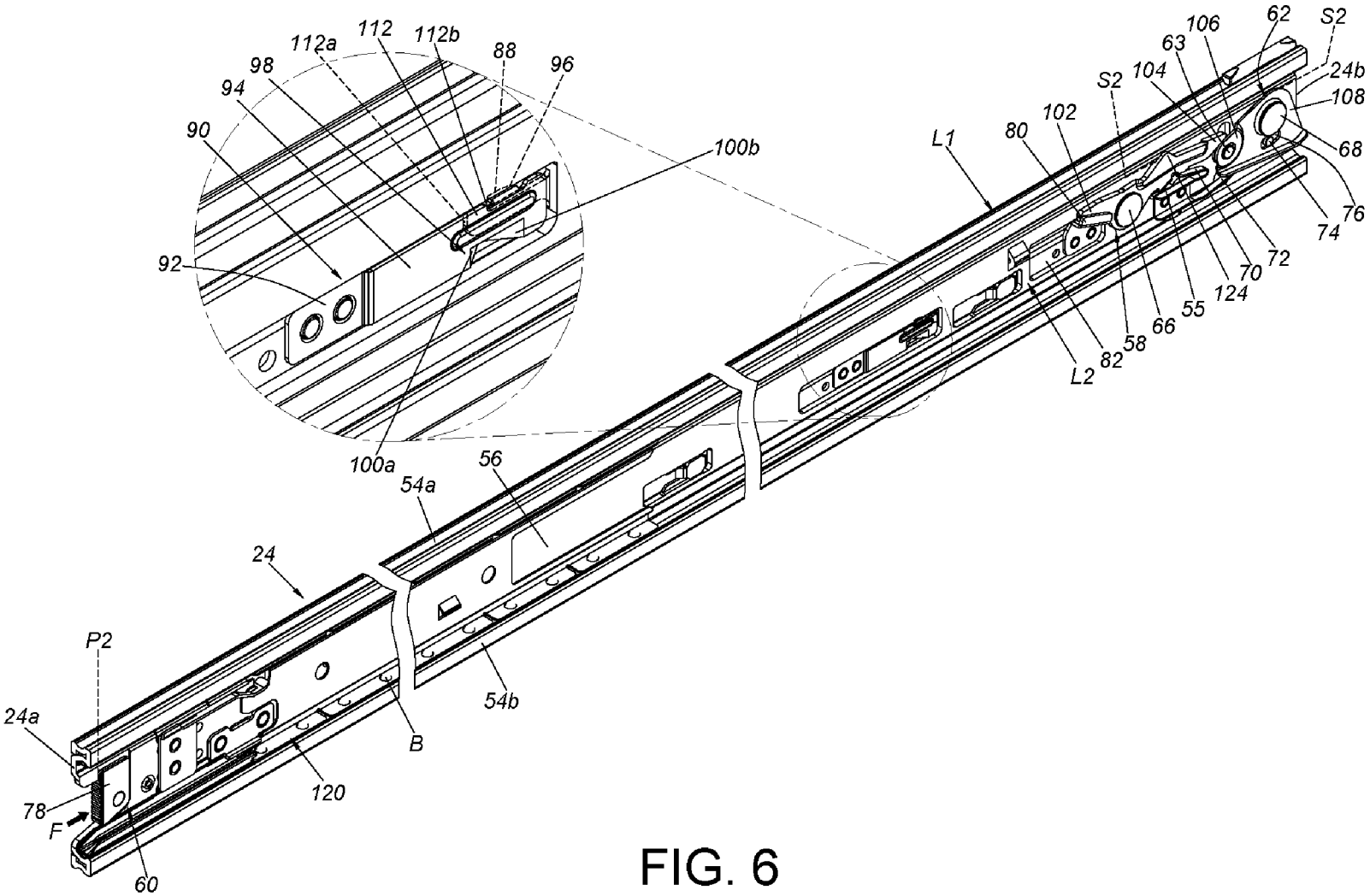
FIG. 6 is a schematic perspective view of the second rail of the slide rail assembly and an operating member of the slide rail assembly at a second operating position according to one embodiment of the present invention.
Figure 7:
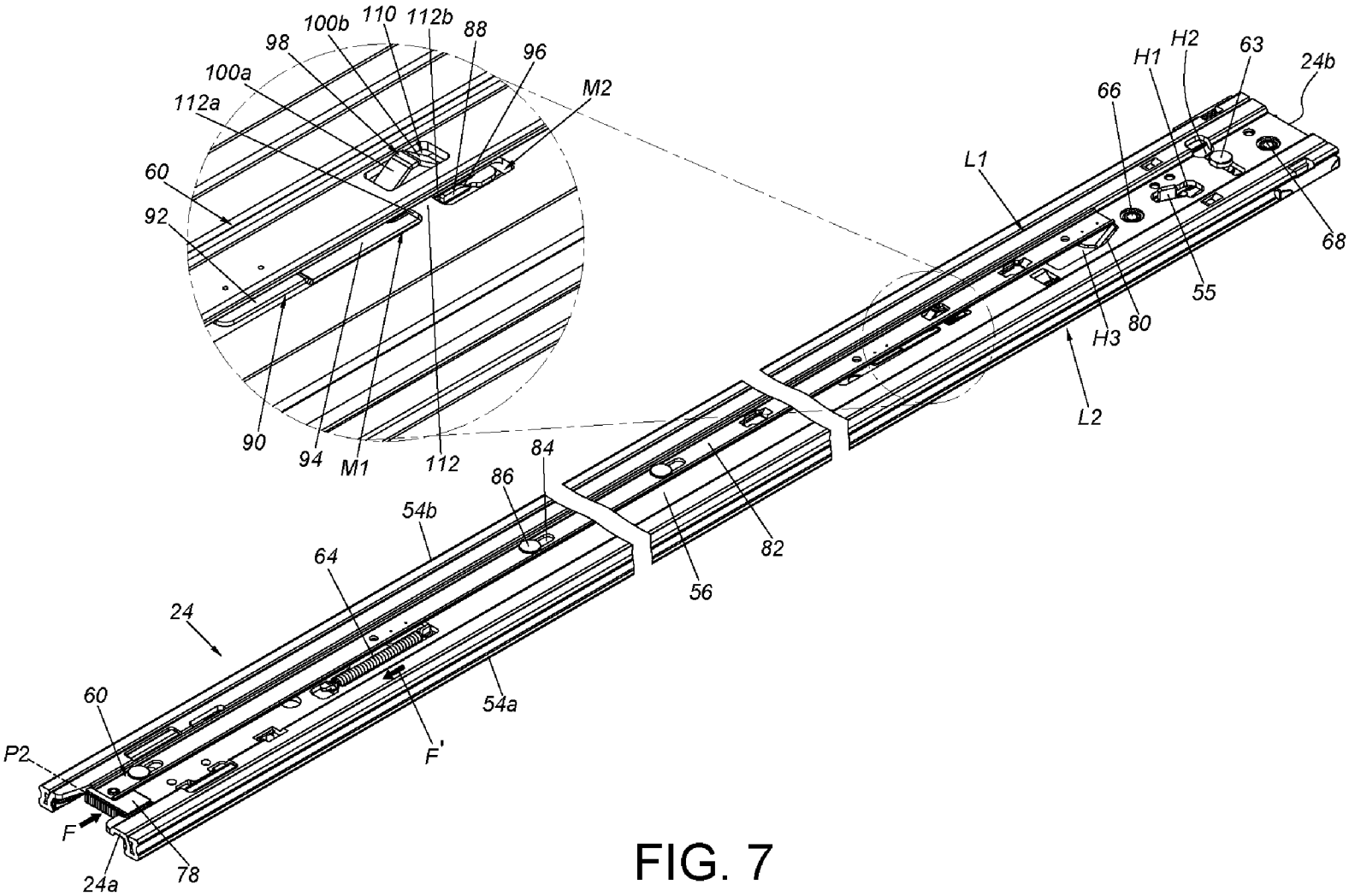
FIG. 7 is another schematic perspective view of the second rail of the slide rail assembly and the operating member of the slide rail assembly at the second operating position according to one embodiment of the present invention.

As shown in FIG. 6 and FIG. 7, the user can apply a force F to the operating member 60 (the operating portion 78), so that the operating member 60 can be moved relative to the second rail 24 from the first operating position P1 to a second operating position P2; during this process, the operating member 60 contacts the contact portion 102 of the blocking member 58 through the driving portion 80 to drive the blocking member 58 to be moved (e.g., pivotally rotate) from being at the first state S1 to a second state S2 (as shown in FIG. 6). Preferably, the blocking member 58 contacts the positioning portion 63 of the positioning member 62 through the actuation portion 104 to drive the positioning member 62, such that the positioning member 62 is moved (e.g., pivotally rotates) from being at the above-mentioned first state S1 to the second state S2 (as shown in FIG. 6).

When the operating member 60 is positioned at the second operating position P2, the recovering elastic member 64 can accumulate the recovering elastic force F' (as shown in FIG. 7) back to the first operating position P1, and the engaging feature 88 of the elastic component 90 corresponds to the second corresponding space M2, and the operating member 60 is engaged with a predetermined portion of the second rail 24 through the engaging feature 88 (e.g., the engaging feature 88 is engaged with a second wall portion 112*b* of the predetermined wall 112 of the second rail 24), such that the operating member 60 is positioned at the second operating position P2 (as shown in FIG. 7).

Preferably, when the operating member 60 is moved from the first operating position P1 (as shown in FIG. 5) to the second operating position P2 (as shown in FIG. 7), the engaging feature 88 can be contacted with the first wall portion 112*a* (as shown in FIG. 5) through the guiding surface 96, which facilitates the engaging feature 88 to cross over the predetermined wall 112 until the engaging feature 88 corresponds to the second corresponding space M2 (as shown in FIG. 7), such that the engaging feature 88 can be engaged with the second wall portion 112*b* of the predetermined wall 112 of the second rail 24 (as shown in FIG. 7). For example, in one of the implementations, the engaging feature 88 can be abutted against the first wall portion 112*a* and then moved underneath the predetermined wall 112 guided by the guiding surface 96, such that the engaging feature 88 can be engaged with the second wall portion 112*b* once fully emerged from the predetermined wall 112. Therefore, the engaging feature 88 can be efficiently moved from one side to another side (i.e., from the first wall portion 112*a* to the second wall portion 112*b*) of the predetermined wall 112, and more firmly engaged with the second wall portion 112*b* without being dislocated or disengaged.

Preferably, when the operating member 60 is positioned at the second operating position P2, the operating member 60 is used to retain the blocking member 58 and the positioning member 62 at the second state S2 (as shown in FIG. 6). The operating member 60 contacts the positioning member 62 through the blocking member 58 at the second state S2, so that the positioning member 62 is also retained at the second state S2 (as shown in FIG. 6).

Figure 8:
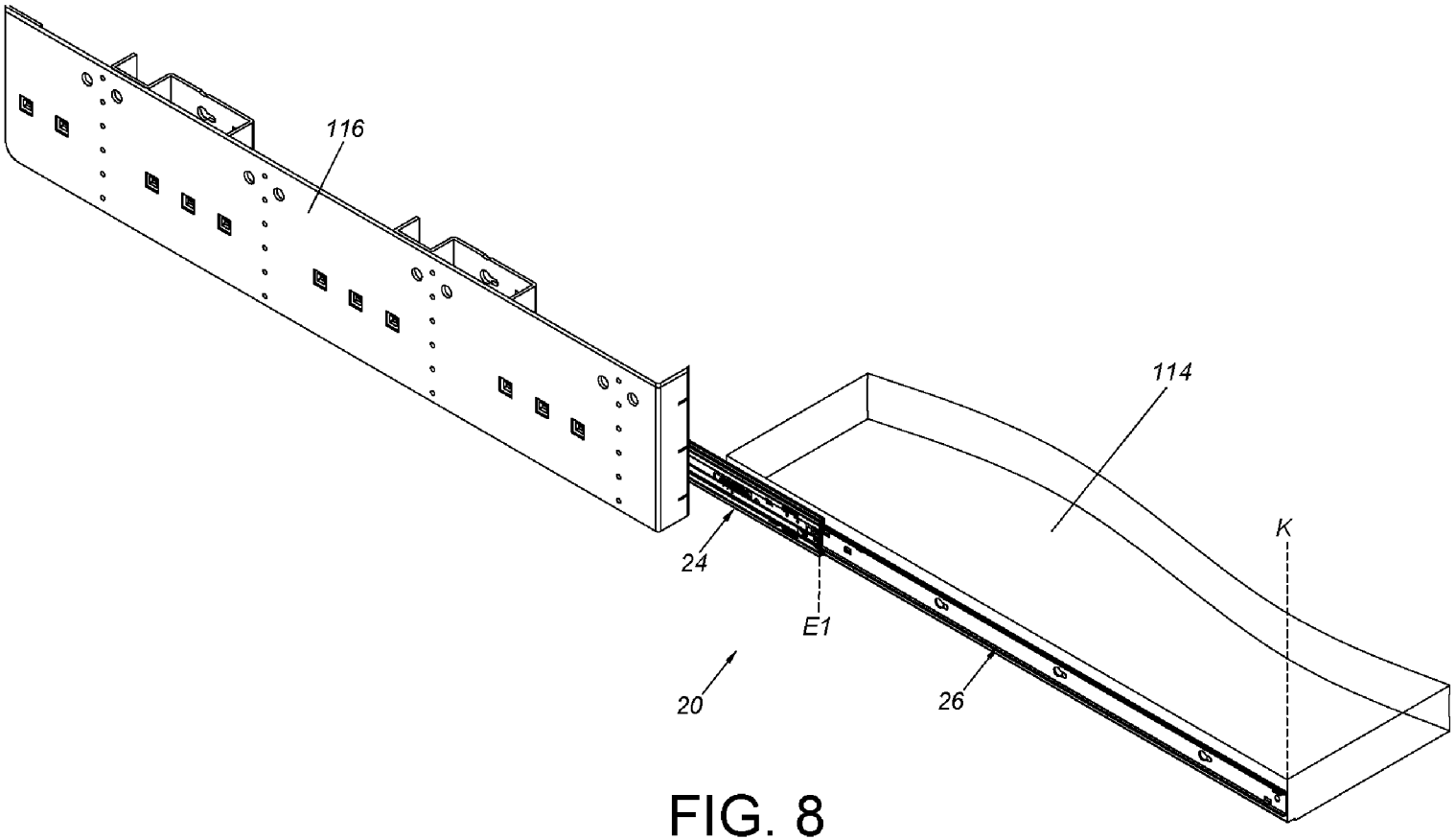
FIG. 8 is a schematic perspective view illustrating the slide rail assembly being adapted to a rack and carrying a carrier according to one embodiment of the present invention.

As shown in FIG. 8, a carrier 114 can be mounted on a frame 116 through the slide rail assembly 20. The slide rail assembly 20 is in the fully extended state. In addition, the first rail 22 is mounted on (or fixed to) the rack 116 (the first rail 22 is not shown in FIG. 8 due to the view angle), and the third rail 26 is used to carry the carrier 114, such that the carrier 114 can be moved between the inside of the frame 116 and the outside of the frame 116 through the third rail 26.

Figure 9:
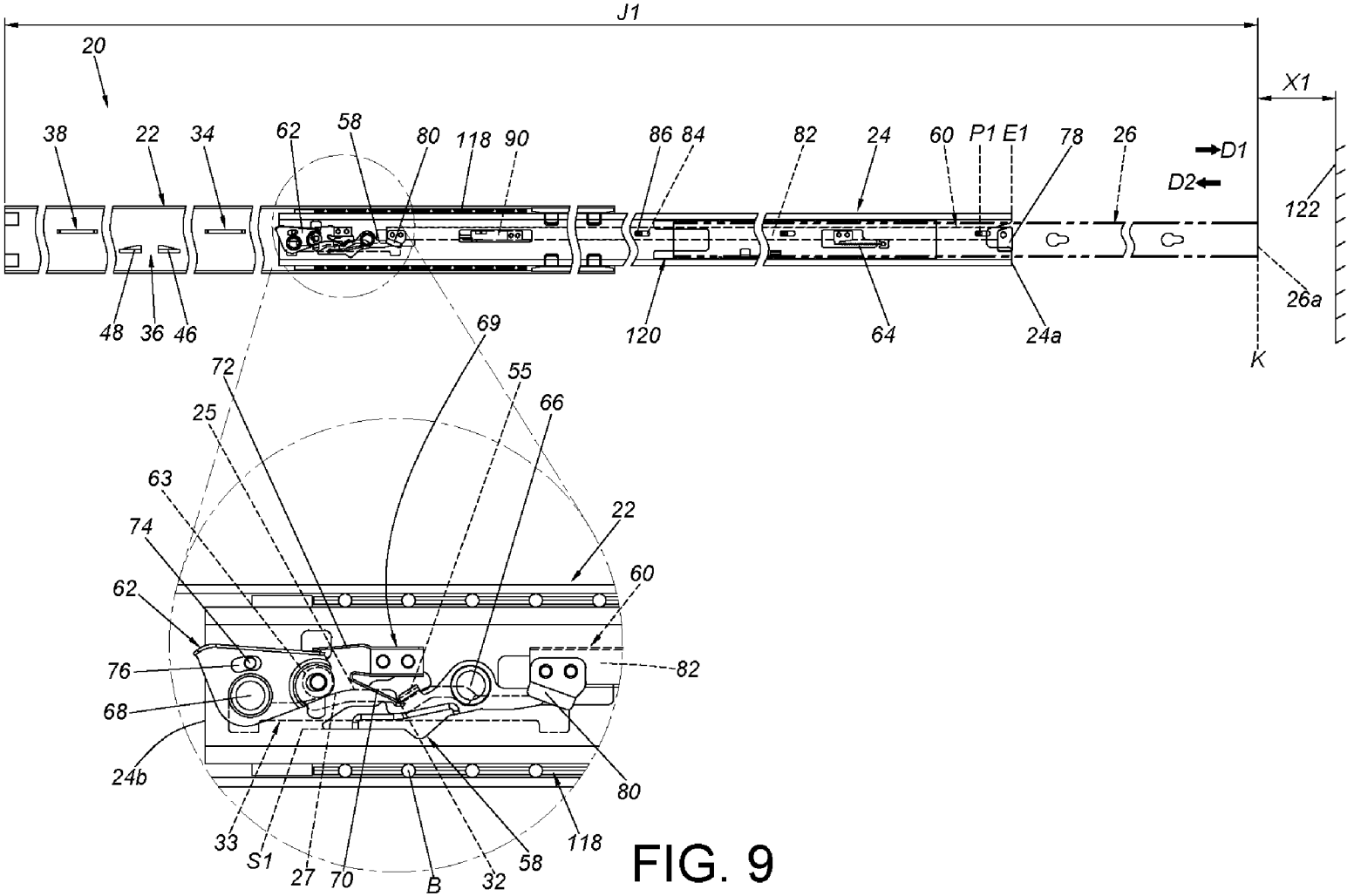
FIG. 9 is a schematic view illustrating the slide rail assembly at the extending state having a first length, and the operating member being positioned at the first operating position according to one embodiment of the present invention.

As shown in FIG. 9, the slide rail assembly 20 is at the fully extended state. The second rail 24 is positioned at the first extending position E1 relative to the first rail 22, and the third rail 26 is at the open position K relative to the second rail 24. Preferably, at least one auxiliary slide device is movably arranged between every two of the slide rails to facilitate the smoothness of the relative movement of each of the two slide rails. For example, a first auxiliary slide device 118 is arranged between the first rail 22 and the second rail 24, and a second auxiliary slide device 120 is arranged between the second rail 24 and the third rail 26, and each of the auxiliary slide devices 118, 120 includes a plurality of balls B. It is worth mentioning that, when the second rail 24 is positioned at the first extending position E1 relative to the first rail 22, the slide rail assembly 20 has a first length J1, such that a first distance X1 is between the front end 26*a* of the third rail 26 and an object 122 (e.g., a door or an obstacle). In addition, since the first distance X1 is too narrow, the third rail 26 is unable to be moved in an extending direction D1 and be disengaged from the second channel of the second rail 24. When the second rail 24 is positioned at the first extending position E1 relative to the first rail 22, the blocking feature 32 can block the blocking portion 55 of the blocking member 58 in the first state S1 to prevent the second rail 24 from being moved from the first extending position E1 in a retracting direction D2. On the other hand, the positioning member 62 contacts the guiding portion 27 of the elastic seat 33 of the first rail 22 through the positioning portion 63. In addition, the operating member 60 is in the first operating position P1, the recovering elastic member 64 is in a state of not accumulated with the recovering elastic force, and the engaging feature 88 of the elastic section 94 of the elastic component 90 is adjacent to the first wall portion 112*a* of the predetermined wall 112 (as shown in FIG. 5).

Figure 10:
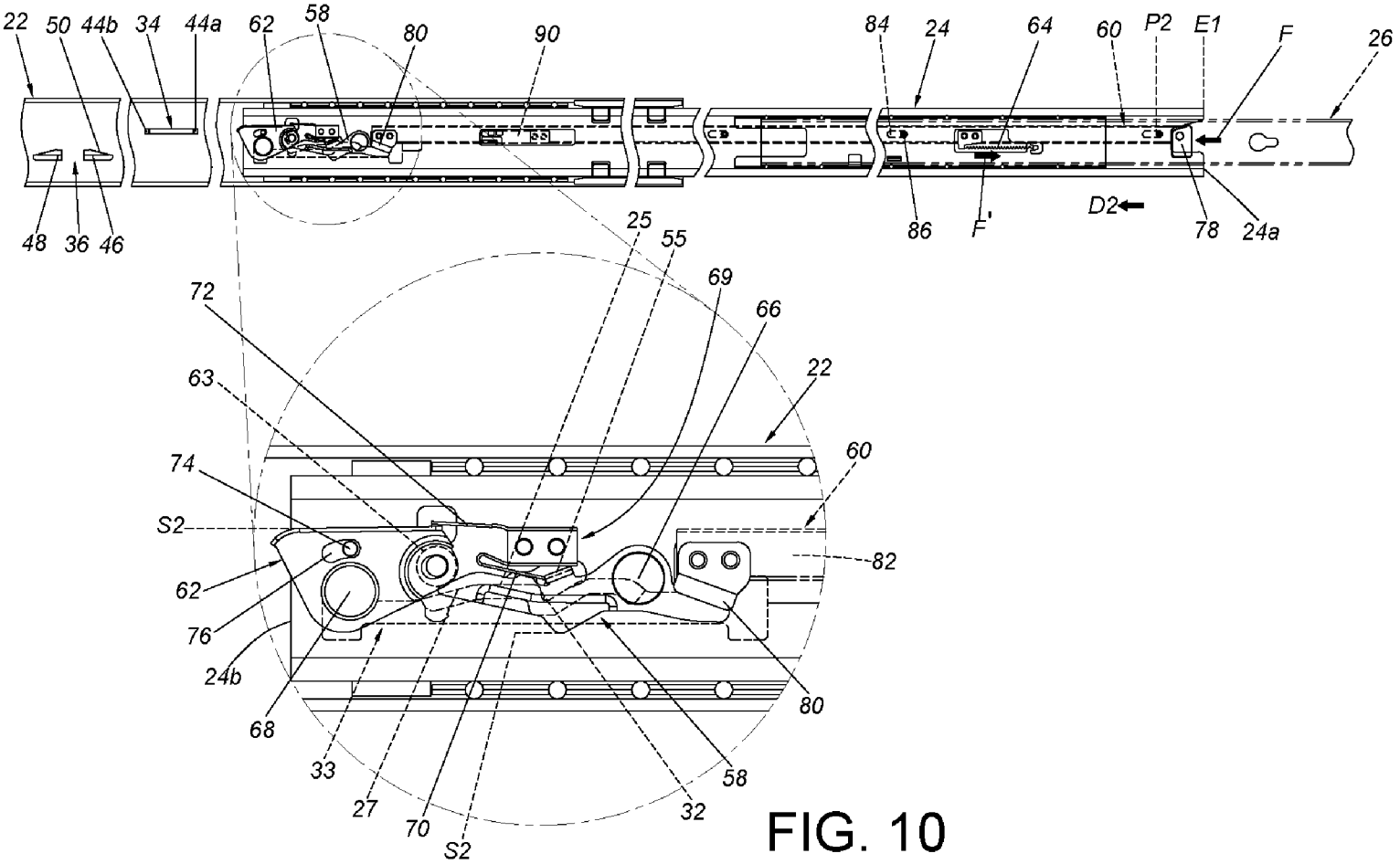
FIG. 10 is a schematic view illustrating the slide rail assembly at the extending state, and the operating member being positioned at the second operating position according to one embodiment of the present invention.

As shown in FIG. 10, the user can move the operating member 60 from the first operating position P1 to the second operating position P2, through applying the force F to the operating portion 78 of the operating member 60, and the driving portion 80 can drive the operating member 60 to be moved from the first operating position P1 to the second operating position P2, so that the blocking feature 32 is unable to block the blocking member 58 at the second state S2, so as to allow the second rail 24 to be moved from the first extending position E1 in the retracting direction D2 relative to the first rail 22. On the other hand, the blocking member 58 motivates the positioning member 62, such that the positioning member 62 is at the second state S2. When the blocking member 58 and the positioning member 62 are at the second state S2, the first elastic feature 70 and the second elastic feature 72 are respectively in a state of accumulating elasticity (as shown in FIG. 6). In addition, when the operating member 60 is positioned at the second operating position P2, the recovering elastic member 64 is in a state of being accumulated with the recovering elastic force F', and the engaging feature 88 of the elastic section 94 of the elastic component 90 is engaged with the second wall portion 112*b* of the predetermined wall 112 of the second rail 24, and is used to retain the operating member 60 at the second operating position P2 (as shown in FIG. 7).

Figure 11:
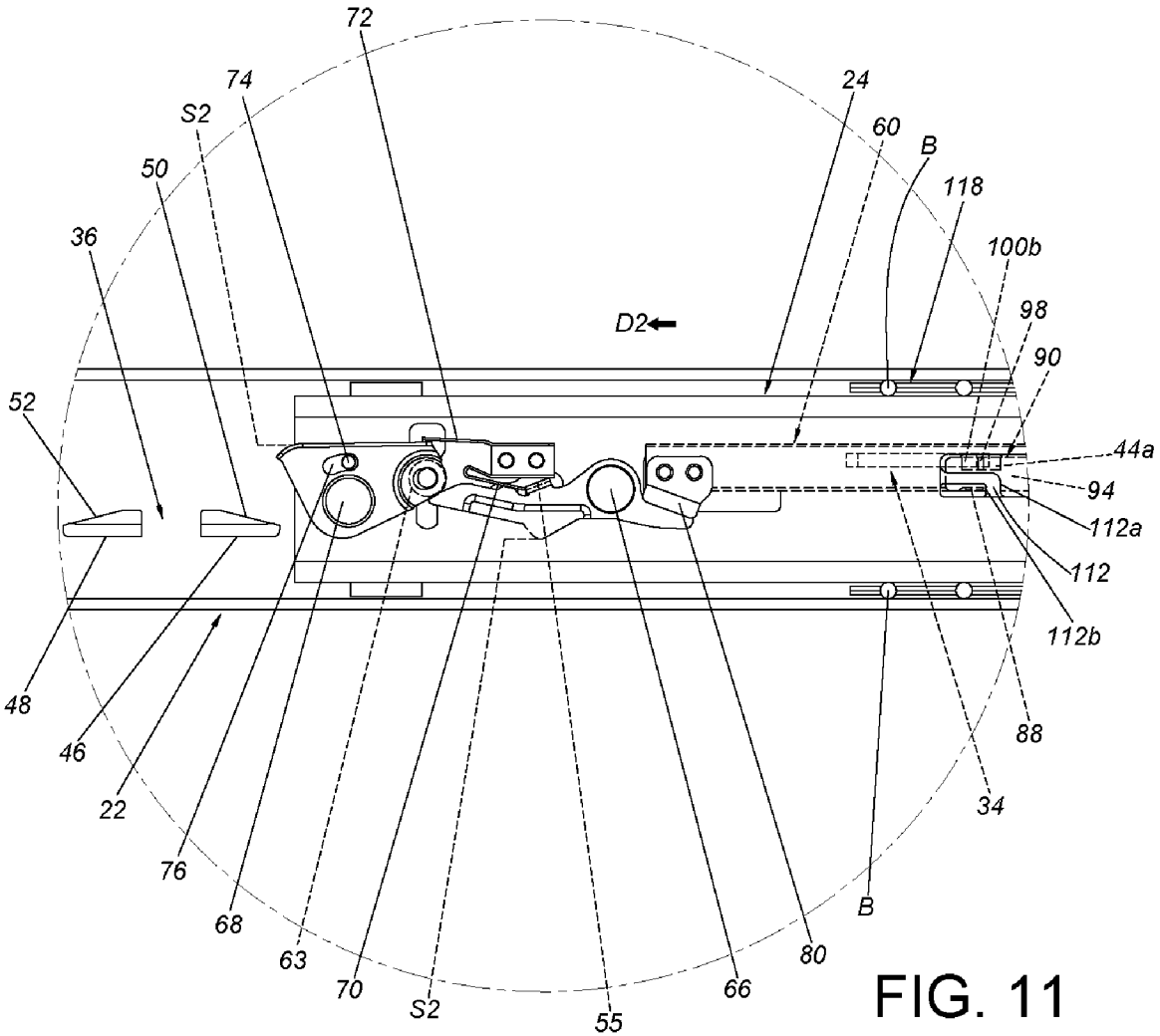
FIG. 11 is a schematic view illustrating the second rail of the slide rail assembly being able to be moved in a retracting direction relative to the first rail according to one embodiment of the present invention.

As shown in FIG. 11, when the second rail 24 is moved from the first extending position E1 in the retracting direction D2 relative to the first rail 22, (the second guiding feature 100*b* of) the release feature 98 of the elastic component 90 of the operating member 60 and (the first guiding section 44*a* of) the first released feature 34 of the first rail 22 are in contact with each other, such that the elastic section 94 of the elastic component 90 can be driven to disengage the engaging feature 88 from the second wall portion 112*b* of the predetermined wall 112 of the second rail 24.

Figure 12:
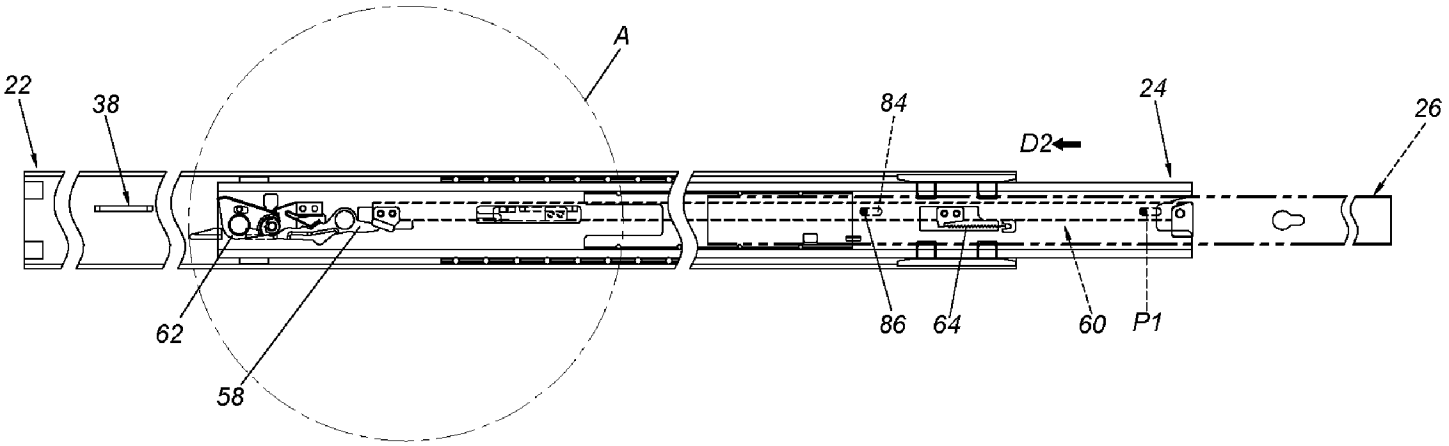
FIG. 12 is a schematic view illustrating the second rail of the slide rail assembly being moved continuously in the retracting direction relative to the first rail according to one embodiment of the present invention.
Figure 13:
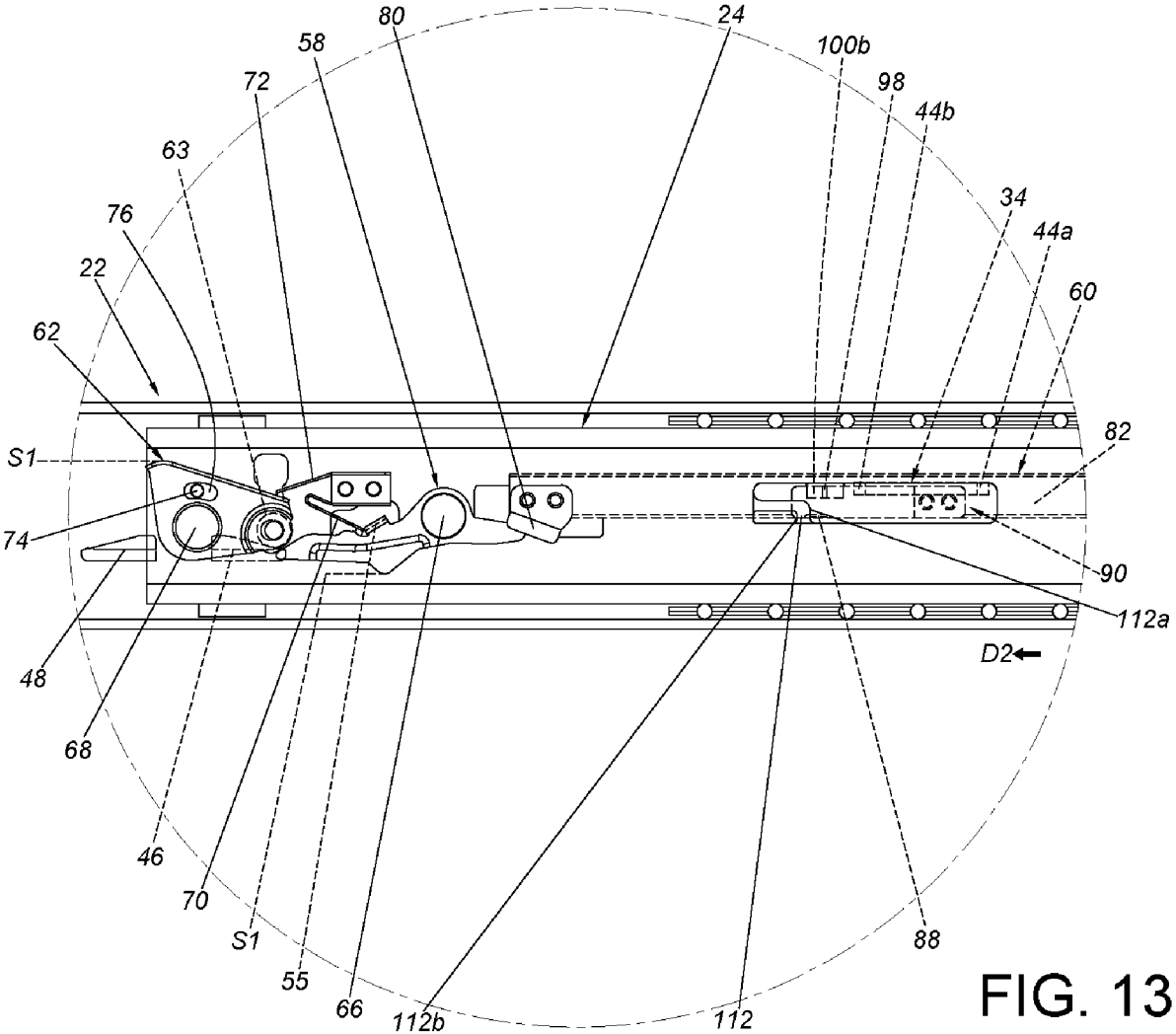
FIG. 13 is an enlarged schematic view of part A in FIG. 12.

As shown in FIG. 12 and FIG. 13, the second rail 24 can be moved continuously in the retracting direction D2 relative to the first rail 22. Once the engaging feature 88 is no longer engaged with the second wall portion 112*b* of the predetermined wall 112 of the second rail 24, the recovering elastic member 64 releases the recovering elastic force F' to the operating member 60, so that the operating member 60 can return from the second operating position P2 to the first operating position P1, and that the engaging feature 88 returns to the position of the first wall portion 112*a* of the predetermined wall 112 adjacent to the second rail 24 (as shown in FIG. 13, which can be read in conjunction with FIG. 5), and the blocking member 58 and the positioning member 62 respectively respond to the elastic force provided by the first elastic feature 70 and the second elastic feature 72, and return from the second state S2 to the first state S1.

Figure 15:
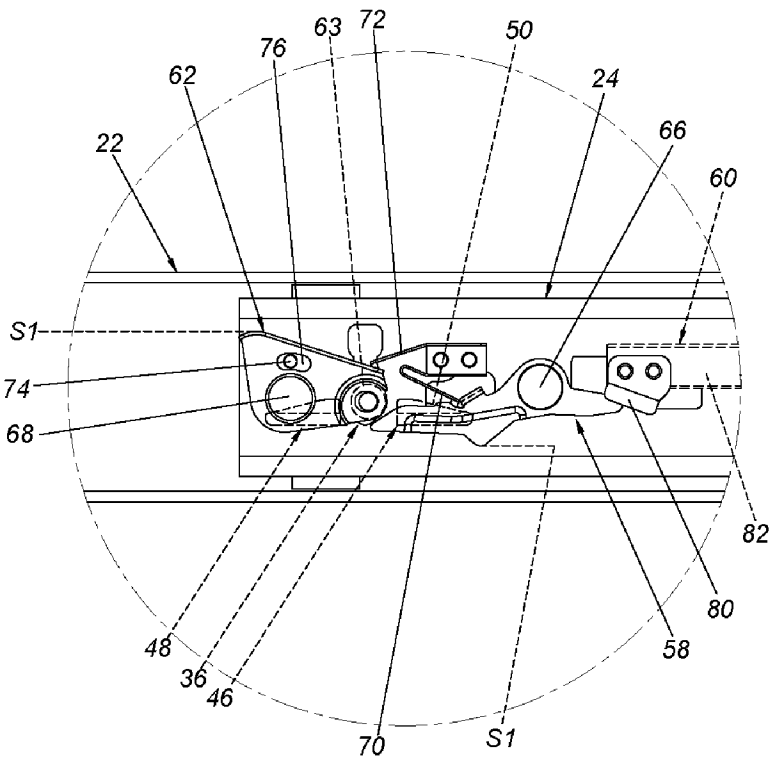
FIG. 15 is a schematic view of the second rail of the slide rail assembly positioned at a second extending position relative to the first rail according to one embodiment of the present invention.
Figure 14:
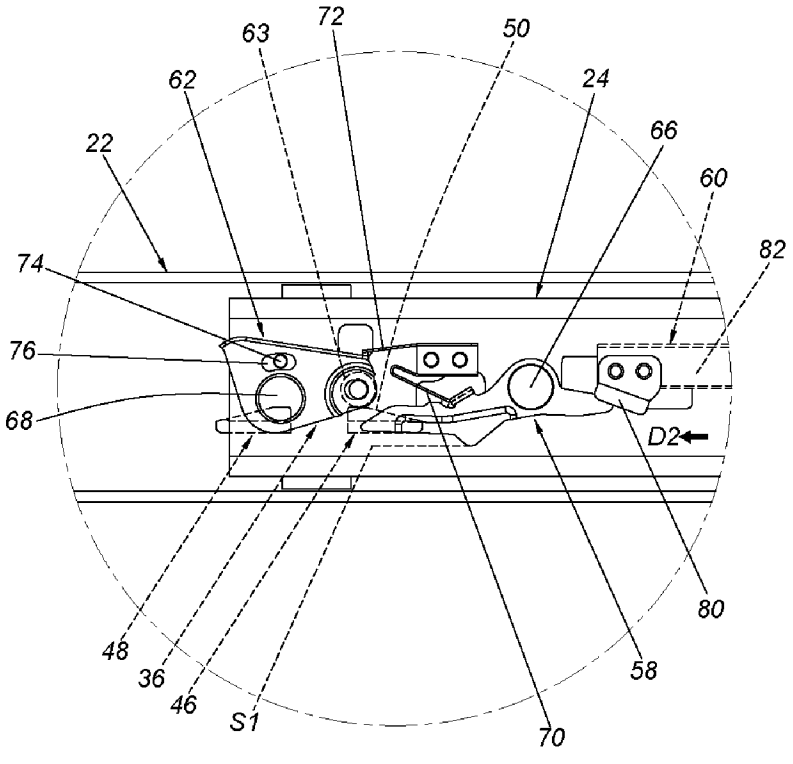
FIG. 14 is a schematic view illustrating the second rail of the slide rail assembly further being moved in the retracting direction relative to the first rail according to one embodiment of the present invention.
Figure 16:
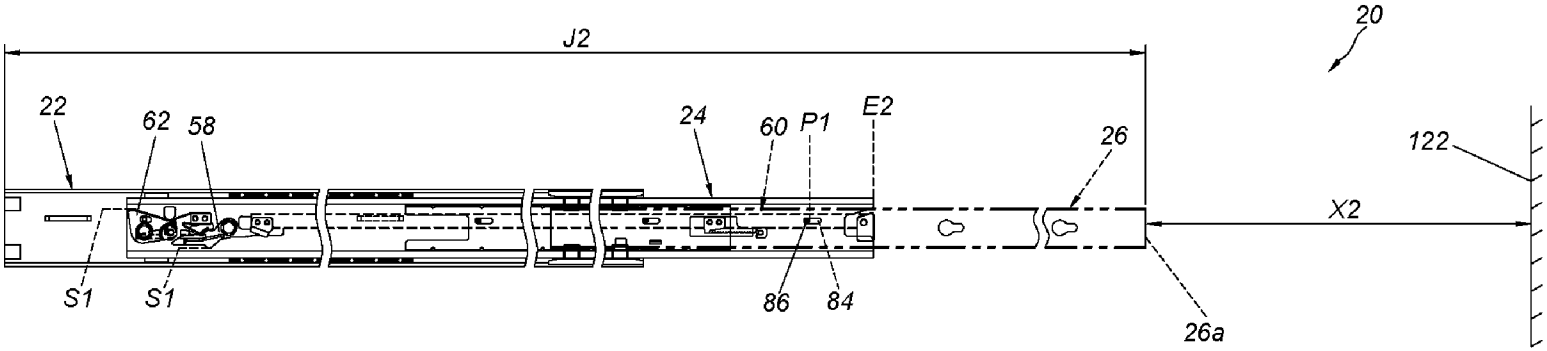
FIG. 16 is a schematic view illustrating the slide rail assembly at another extending state having a second length according to one embodiment of the present invention.

As shown in FIG. 14 and FIG. 15, when the second rail 24 is further moved in the retracting direction D2 to a second extending position E2 relative to the first rail 22, the positioning member 62 is pivotally rotated for a certain angle through being guided by the positioning portion 63 along the first guiding structure 50 (e.g., an inclined surface or an arc surface) of the first auxiliary portion 46, so that the second elastic feature 72 is in a state of accumulated with elasticity (as shown in FIG. 14); until the second rail 24 positioned at the second extending position E2 (as shown in FIG. 16), the positioning member 62 responds to the elastic force of the second elastic feature 72 to be at the first state S1, so that the positioning portion 63 of the positioning member 62 is engaged with the positioning feature 36 of the first rail 22. For example, the positioning portion 63 of the positioning member 62 is arranged between the first auxiliary portion 46 and the second auxiliary portion 48 to prevent the second rail 24 from being moved relative to the first rail 22 from the second extending position E2 in the retracting direction D2 or the extending direction D1.

Figure 17:
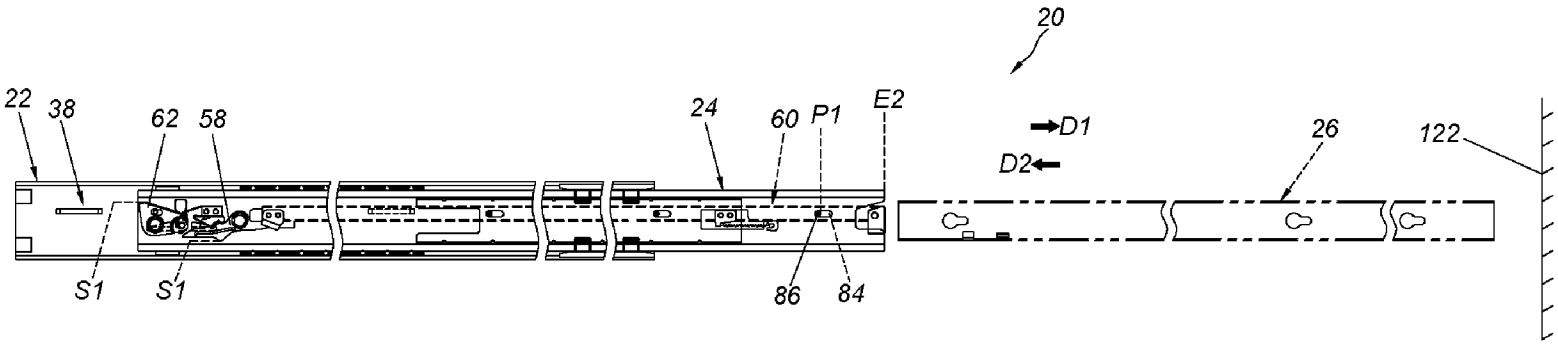
FIG. 17 is a schematic view illustrating the slide rail assembly at another extending state, and the third rail being able to be disengaged from the second rail according to one embodiment of the present invention.

As shown in FIG. 16 and FIG. 17, when the second rail 24 is at the second extending position E2 relative to the first rail 22, the slide rail assembly 20 has a second length J2 smaller than the aforementioned first length J1, so that a second distance X2, defined between the front end portion 26*a* of the third rail 26 and the object 122, is greater than the above-mentioned first distance X1. Therefore, it is advantageous for the third rail 26 to be moved in the extending direction D1 and be disengaged from the second channel of the second rail 24 (as shown in FIG. 17).

Figure 20:
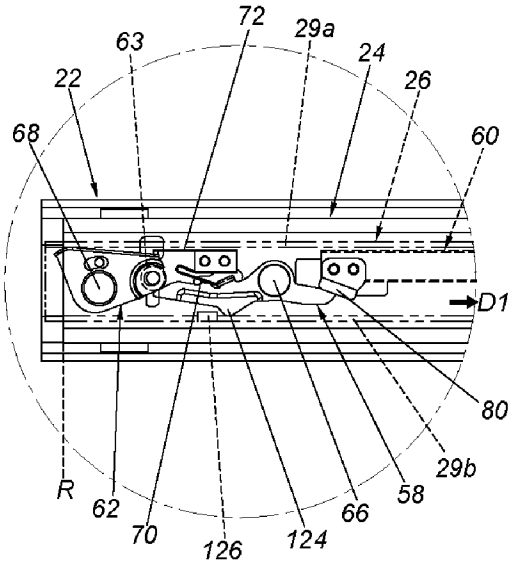
FIG. 20 is a schematic view of the slide rail assembly at a fully retracted state according to one embodiment of the present invention.
Figure 19:
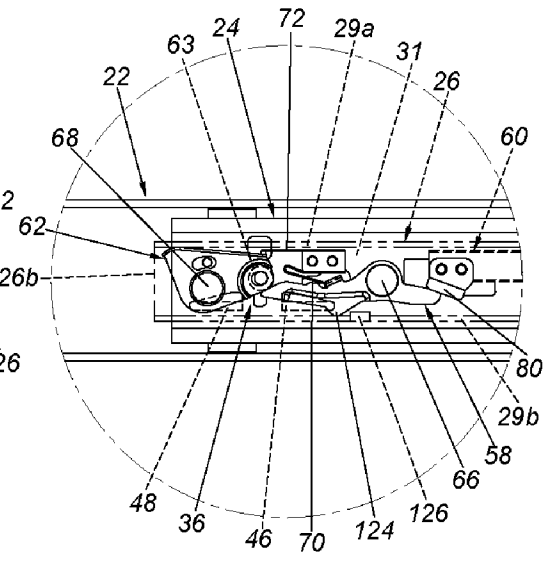
FIG. 19 is a schematic view illustrating the third rail of the slide rail assembly being moved continuously in the retracting direction relative to the second rail according to one embodiment of the present invention.
Figure 18:
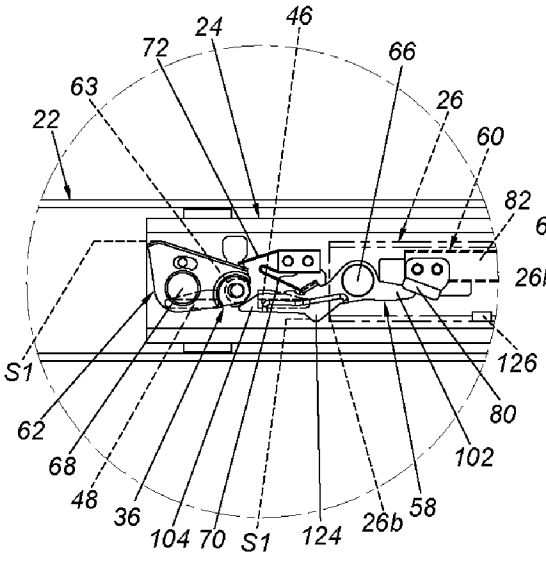
FIG. 18 is a schematic view illustrating the third rail of the slide rail assembly being moved in the retracting direction relative to the second rail according to one embodiment of the present invention.

As shown in FIG. 18 to FIG. 20, the third rail 26 includes a first wall 29*a*, a second wall 29*b*, and a longitudinal wall 31 connected between the first wall 29*a* and the second wall 29*b* of the third rail 26. Furthermore, when the second rail 24 is to be moved from the second extending position E2 in the retracting direction D2 to a retracted position R (e.g., a fully retracted position) relative to the first rail 22, the second rail 24 can be moved to a retracted position R (e.g., a fully retracted position). The third rail 26 is moved from the open position K in the retracting direction D2 until (the back end 26*b* of) the third rail 26 contacts an auxiliary section 124 of the blocking member 58 (the auxiliary section 124 is connected to the actuation portion 104 of the blocking member 58, as shown in FIG. 18), such that the blocking member 58 is no longer at the first state S1, and the positioning member 62 motivated by the blocking member 58 is also no longer at the first state S1, and that the positioning portion 63 of the positioning member 62 is released from the positioning feature 36 (as shown in FIG. 19) to allow the second rail 24 to be moved from the second extending position E2 in the retracting direction D2 relative to the first rail 22, until the slide rail assembly 20 is at a fully retracted state (as shown in FIG. 20). At this time, the second rail 24 is in the retracted position R relative to the first rail 22, and the third rail 26 is in a predetermined retracted position relative to the second rail 24. It is worth mentioning that, as shown in FIG. 19 and FIG. 20, the second wall 29*b* and the first wall 29*a* of the third rail 26 respectively support the blocking member 58 and the positioning member 62 to retain the blocking member 58 and the positioning member 62 to not be at the first state S1 (i.e., the blocking member 58 and the positioning member 62 are no longer at the first state S1), and the first elastic feature 70 and the second elastic feature 72 are in the state of accumulated with elasticity. It is worth mentioning that, since the first wall 29*a* of the third rail 26 is on a movement path (a pivotally rotation path) of the positioning member 62, the positioning member 62 can be retained in a state other than the first state S1.

Figure 23:
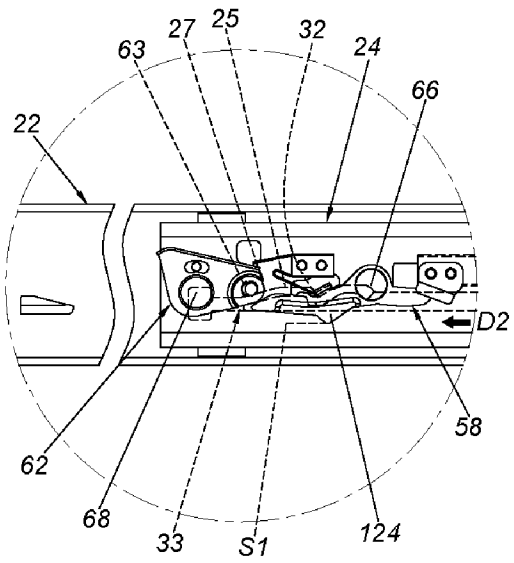
FIG. 23 is a schematic view illustrating the third rail of the slide rail assembly further being moved in the extending direction relative to the second rail according to one embodiment of the present invention.
Figure 22:
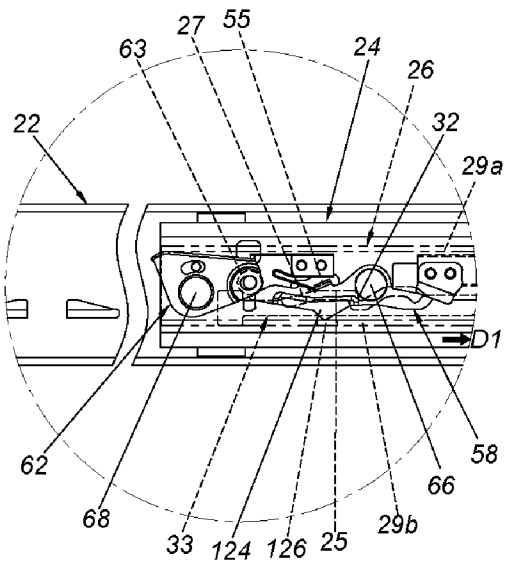
FIG. 22 is a schematic view illustrating the third rail of the slide rail assembly being moved continuously in the extending direction relative to the second rail according to one embodiment of the present invention.
Figure 21:
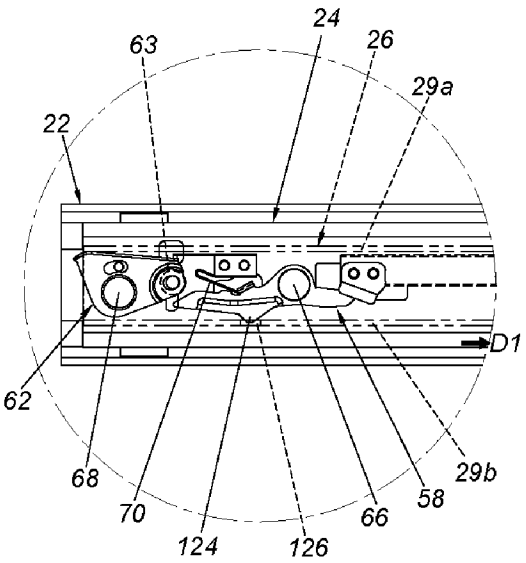
FIG. 21 is a schematic view illustrating the third rail of the slide rail assembly being moved in an extending direction relative to the second rail according to one embodiment of the present invention.

As shown in FIG. 20 to FIG. 23, the third rail 26 includes a synchronization feature 126 (for example, a hole wall, but the present invention is not limited thereto) mounted on the second wall 29*b* of the third rail 26. Furthermore, when the third rail 26 is moved relative to the second rail 24 from the retracted position (as shown in FIG. 20) to the extending direction D1 for a predetermined stroke, the synchronization feature 126 of the third rail 26 corresponds to the auxiliary section 124 of the blocking member 58, such that the blocking member 58 responds to the elastic force provided by the first elastic feature 70 and is engaged with the synchronization feature 126 of the third rail 26 through the auxiliary section 124 to allow the second rail 24 to be moved simultaneously with the third rail 26 the extending direction D1 (as shown in FIG. 21). When the blocking member 58 is moved in the extending direction D1 for the predetermined stroke, the blocking portion 55 of the blocking member 58 is moved in the extending direction D1 along the guiding portion 27 of the elastic seat 33 of the first rail 22 and reaches the longitudinal portion 25 of the elastic seat 33, such that the blocking member 58 is rotated for an angle, and that the auxiliary section 124 of the blocking member 58 is disengaged from the synchronization feature 126 of the third rail 26, thereby dismissing the simultaneously movement between the second rail 24 and the third rail 26 (as shown in FIG. 22). When the third rail 26 is moved in the extending direction D1 relative to the second rail 24, so that the second wall 29*b* and the first wall 29*a* of the third rail 26 no longer support the blocking member 58 and the positioning member 62, respectively, and the second rail 24 is moved relative to the first rail 22 to the first extending position E1, the blocking member 58 is at the first state S1, and the blocking portion 55 of the blocking member 58 is blocked by the blocking feature 32 of the first rail 22 to prevent the second rail 24 from being moved from the first extending position E1 in the retracting direction D2 (as shown in FIG. 23, which can be read in conjunction with FIG. 9).

Figure 24:
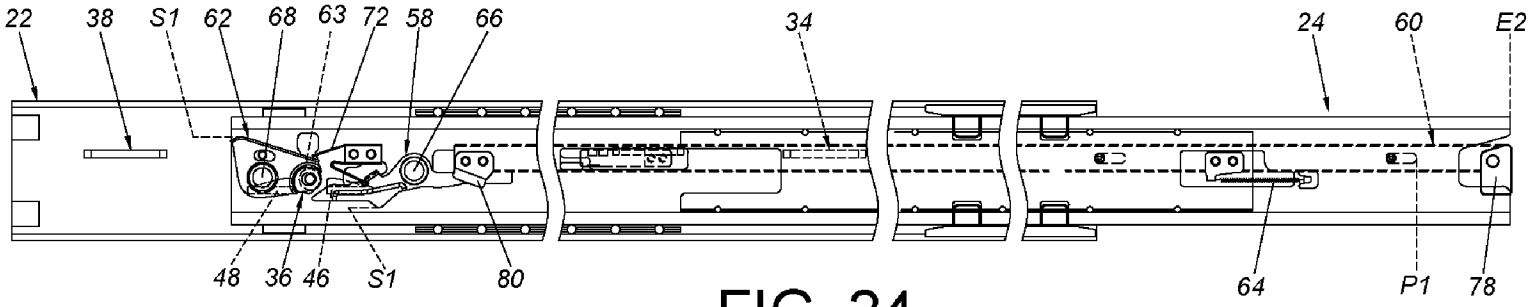
FIG. 24 is a schematic view illustrating the second rail of the slide rail assembly being positioned at the second extending position relative to the first rail, and the operating member being positioned at the first operating position according to one embodiment of the present invention.
Figure 25:
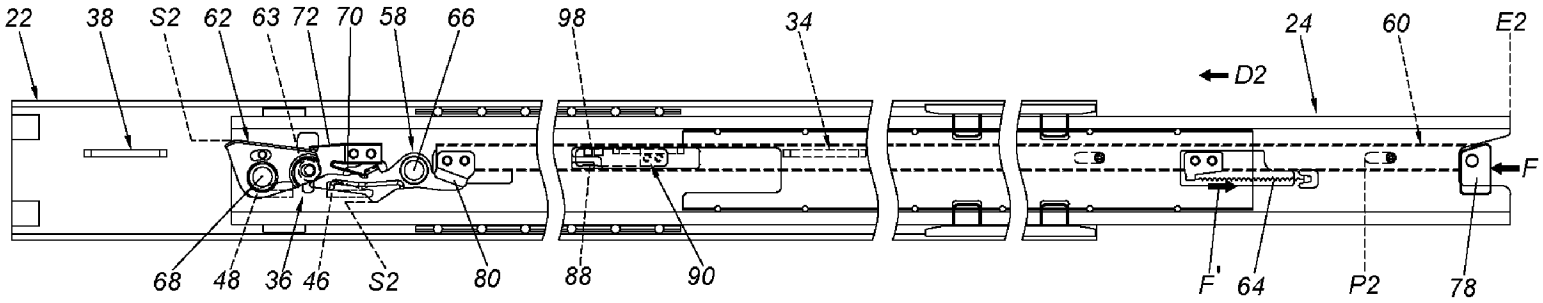
FIG. 25 is a schematic view illustrating the second rail of the slide rail assembly being positioned at the second extending position relative to the first rail, and the operating member being positioned at the second operating position according to one embodiment of the present invention.

As shown in FIG. 24 and FIG. 25, when the second rail 24 is in the second extending position E2 relative to the first rail 22, in addition to the above-mentioned manner of the third rail 26 relieving an engaging relation between (i.e., the simultaneous movement of) the second rail 24 and the first rail 22(for example, as shown in FIG. 18 and FIG. 19), in one of the implementations, the user can also directly relieve the engaging relation between the second rail 24 and the first rail 22 through the operating member 60. Furthermore, when the second rail 24 is at the second extending position E2 relative to the first rail 22, the user can apply the force F to the operating member 60, so as to move the operating member 60 from the first operating position P1 to the second operating position P2, such that the blocking member 58 can be driven by the driving portion 80 from being at the first state S1 to the second state S2, and the blocking member 58 can drive the positioning member 62 from being at the first state S1 to the second state S2, and the positioning portion 63 of the positioning member 62 is disengaged from the positioning feature 36 of the first rail 22, which allow the second rail 24 to be moved from the second extending position E2 in the retracting direction D2 (or the extending direction D1) relative to the first rail 22. When the operating member 60 is positioned at the second operating position P2, the operating member 60 is engaged with the predetermined portion of the second rail 24 through the engaging feature 88 to retain the operating member 60 at the second operating position P2 (as shown in FIG. 7).

When the second rail 24 is being moved from the second extending position E2 in the retracting direction D2 to the retracted position R, the second released feature 38 of the first rail 22 can drive the elastic component 90 to disengage the engaging feature 88 from the predetermined portion of the second rail 24, so that the operating member 60 can return to the first operating position P1 from the second operating position P2 through the recovering elastic force F' of the recovering elastic member 64. In addition, the technical principle described herein is substantially identical to that of FIG. 11, and will not be reiterated.

One of the beneficial effects of the slide rail assembly 20 and the slide rail kit of the present invention is that the operating member 60 can be retained at the second operating position P2 through the engaging feature 88 being engage with the predetermined portion of the second rail 24, and once the engaging feature 88 is no longer engaged with the predetermined portion of the second rail 24, the recovering elastic force provided by the recovering elastic member 64 allows the operating member 60 to return from the second operating position P2 to the first operating position P1.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail comprising a blocking feature;

a second rail movable relative to the first rail, the second rail comprising a predetermined portion;

a blocking member and a positioning member being movably mounted on the second rail, such that the blocking member and the positioning member, relative to the second rail, are both respectively at one of a first state and a second state;

an operating member configured to operate the blocking member;

a recovering elastic member; and a first elastic feature;

wherein, when the second rail is positioned at a first extending position relative to the first rail, the blocking feature blocks the blocking member at the first state, so as to prevent the second rail from being moved from the first extending position in a retracting direction;

wherein the blocking member is movable from the first state to the second state through having the operating member operatively moved from a first operating position to a second operating position, such that the blocking feature is unable to block the blocking member at the second state, so as to allow the second rail to be moved in the retracting direction from the first extending position;

wherein, when the operating member is positioned at the second operating position, the operating member is engaged with the predetermined portion through an engaging feature, such that the operating member is retained at the second operating position;

wherein, when the operating member is positioned at the second operating position, the operating member retains the blocking member and the positioning member respectively at the second state;

wherein, when the engaging feature is no longer engaged with the predetermined portion of the second rail, a recovering elastic force provided by the recovering elastic member is applied to the operating member, so as to return the operating member from the second operating position to the first operating position;

wherein, when the operating member is positioned at the first operating position, the blocking member is returned from the second state to the first state in response to an elastic force provided by the first elastic feature.

2. The slide rail assembly of claim 1, wherein the operating member is able to be operatively mounted on the second rail.

3. The slide rail assembly of claim 1, wherein, when the operating member is positioned at the second operating position, the operating member is contacted with the positioning member through the blocking member at the second state, such that the positioning member is retained at the second state.

4. The slide rail assembly of claim 1, further comprising:

a second elastic feature, when the operating member is positioned at the first operating position, the positioning member is returned from the second state to the first state in response to the elastic force provided by the second elastic feature.

5. The slide rail assembly of claim 4, further comprising an elastic component mounted on the operating member, the elastic component comprising the engaging feature.

6. The slide rail assembly of claim 5, wherein the first rail further includes a first released feature; when the second rail is moved from the first extending position in the retracting direction to a second extending position, the engaging feature is disengaged from the predetermined portion of the second rail through the elastic component being moved by the first released feature of the first rail.

7. The slide rail assembly of claim 6, wherein the first rail further comprises a positioning feature; when the second rail is positioned at the second extending position, the second rail is prevented from being moved relative to the first rail in the retracting direction from the second extending position through the positioning member at the first state being engaged with the positioning feature.

8. The slide rail assembly of claim 7, wherein, when the second rail is positioned at the first extending position, the slide rail has a first length; when the second rail is positioned at the second extending position, the slide rail has a second length which is shorter than the first length.

9. The slide rail assembly of claim 7, further comprising:

a third rail, the second rail being movably mounted between the first rail and the third rail;

wherein, when the second rail is positioned at the second extending position, the positioning member is moved to be no longer at the first state through the third rail being moved, relative to the second rail, from an initial position in the retracting direction, such that the positioning member is dislocated from the positioning feature, which allows the second rail to be moved relative to the first rail from the second extending position in the retracting direction.

10. The slide rail assembly of claim 9, wherein, when the third rail is moved from a predetermined retracted position in an extending direction for a predetermined stroke, the third rail is simultaneously engaged with the blocking member through a synchronization feature, such that the second rail is moved simultaneously with the third rail in the extending direction.

11. The slide rail assembly of claim 7, wherein, when the second rail is positioned at the second extending position, the positioning member is disengaged from the positioning feature through the operating member operatively being moved from the first operating position to the second operating position which moves the positioning member to be dislocated from the first state, so as to allow the second rail to be moved relative to the first rail from the second extending position in the retracting direction; and the engaging feature is engaged with the predetermined portion of the second rail, such that the operating member is retained at the second operating position.

12. The slide rail assembly of claim 11, wherein the first rail further comprises a second released feature; when the second rail is moved from the second extending position to a retracted position in the retracting direction, the engaging feature is disengaged from the predetermined portion of the second rail through the elastic component being moved by the second released feature of the first rail.

13. A slide rail assembly, comprising:

a first rail comprising a blocking feature and a positioning feature;

a second rail movable relative to the first rail, the second rail comprising a predetermined portion;

a third rail movable relative to the second rail;

a blocking member and a positioning member being movably mounted on the second rail, such that the blocking member and the positioning member, relative to the second rail, are both respectively at one of a first state and a second state; and an operating member configured to operate the blocking member;

a recovering elastic member;

a first elastic feature;

an elastic component;

wherein, when the second rail is positioned at a first extending position relative to the first rail, the blocking feature blocks the blocking member at the first state, so as to prevent the second rail from being moved from the first extending position in a retracting direction;

wherein the blocking member is movable from the first state to the second state through having the operating member to be operatively moved from a first operating position to a second operating position, such that the blocking feature is unable to block the blocking member at the second state, so as to allow the second rail to be moved from the first extending position in the retracting direction, and when the operating member is positioned at the second operating position, the operating member is engaged with the predetermined portion of the second rail through an engaging feature, such that the operating member is retained at the second operating position;

wherein, when the operating member is positioned at the second operating position, the operating member retains the blocking member at the second state;

wherein, when the blocking feature is unable to block the blocking member at the second state, the second rail is moved from the first extending position to a second extending position in a retracting direction, such that the second rail is prevented from being moved from the second extending position relative to the first rail in the retracting direction through the positioning member at the first state being engaged with the positioning feature;

wherein, when the second rail is positioned at the second extending position, the positioning member is disengaged from the positioning feature through the operating member being operatively moved from the first operating position to the second operating position which moves the positioning member to be dislocated from the first state, so as to allow the second rail to be moved from the second extending position relative to the first rail in the retracting direction; and the engaging feature is engaged with the predetermined portion of the second rail, such that the operating member is retained at the second operating position;

wherein, when the engaging feature is no longer engaged with the predetermined portion of the second rail, a recovering elastic force provided by the recovering elastic member is applied to the operating member, so as to return the operating member from the second operating position to the first operating position;

wherein, when the operating member is positioned at the first operating position, the blocking member is returned from the second state to the first state in response to an elastic force provided by the first elastic feature;

wherein the first rail further includes a first released feature; when the second rail is moved from the first extending position to the second extending position in the retracting direction, the engaging feature is disengaged from the predetermined portion of the second rail through the elastic component being moved by the first released feature of the first rail.

* * * * *